United States Patent [19]

Leblanc et al.

[11] 4,194,481

[45] Mar. 25, 1980

[54] BREAKER SIGNAL PICK-UP AND SHAPING CIRCUIT

[75] Inventors: Marc Leblanc, Montreuil; Bernard Lepretre, Boulogne, both of France

[73] Assignee: Regie Nationale des Usines Renault, Boulogne-Brillancourt, France

[21] Appl. No.: 868,375

[22] Filed: Jan. 10, 1978

[30] Foreign Application Priority Data

Jan. 21, 1977 [FR] France ..... 77 01721

[51] Int. Cl.[2] ..... F02P 1/00

[52] U.S. Cl. ..... 123/148 E; 324/169; 307/311

[58] Field of Search ..... 324/169; 307/311; 123/148 E

[56] References Cited

U.S. PATENT DOCUMENTS

| | | | |
|---|---|---|---|
| 3,202,910 | 8/1965 | Fathauer | 324/169 |
| 3,323,052 | 5/1967 | Passmore | 324/169 |
| 3,723,769 | 3/1973 | Collins | 307/311 |
| 3,932,770 | 1/1976 | Fantozzi | 307/311 |
| 3,943,896 | 3/1976 | Green | 123/148 E |
| 3,983,480 | 9/1976 | Meserow | 324/169 |

FOREIGN PATENT DOCUMENTS

| | | | |
|---|---|---|---|
| 1432633 | 2/1965 | France | 123/148 E |
| 1435404 | 5/1965 | France | 123/148 E |
| 2088663 | 4/1970 | France | 123/148 E |

*Primary Examiner*—Ronald B. Cox

*Attorney, Agent, or Firm*—Fleit & Jacobson

[57] ABSTRACT

An electronic circuit for picking-up and shaping signals emitted from the breaker of a conventional or electronic ignition system is provided which consists of an infrared optical coupler in which the emitter is connected to the terminal common to both said breaker and the ignition coil of the ignition system via a circuit capable of calibrating said signals and in which the receiver of said infrared optical coupler is connected to the base of a transistor operating between the locked and the saturated condition wherein the output terminals of said transistor are connected to a circuit capable of eliminating stray signals.

3 Claims, 1 Drawing Figure

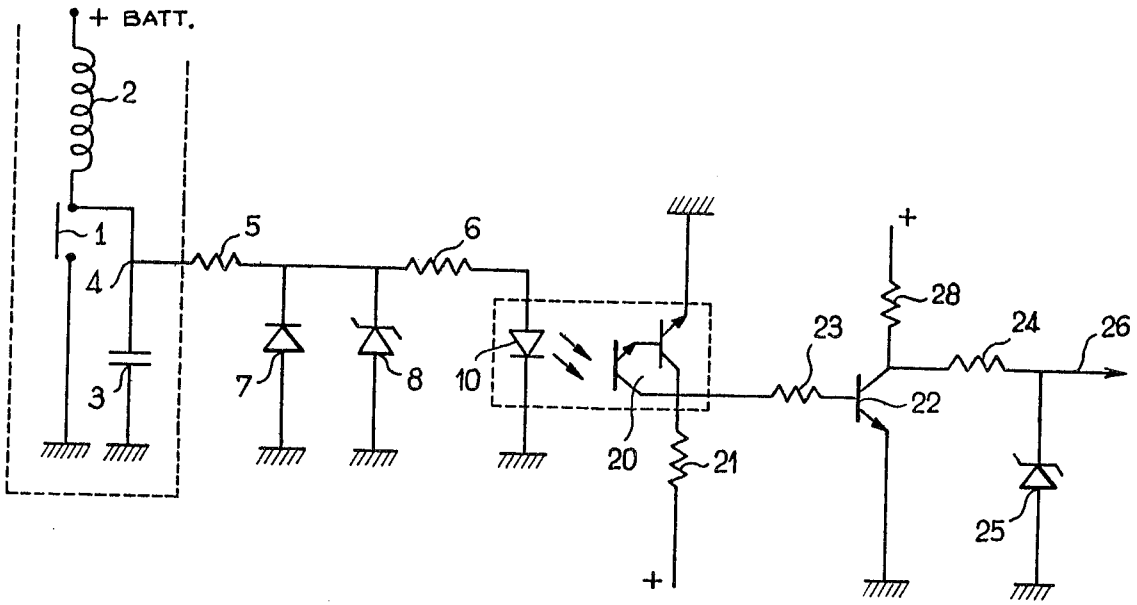
+ BATT.
2
1
4
3
5
7
8
6
10
20
21
+
23
22
28
+
24
25
26

BREAKER SIGNAL PICK-UP AND SHAPING CIRCUIT

The present invention relates in general to electronic circuit means for picking up and shaping a breaker signal in an internal combustion engine ignition system and has specific reference to an electronic apparatus for picking up and shaping the breaker signal received from a conventional or electronic ignition system with the assistance of an infrared optical coupler.

Many research works and propositions directed to shaping signals produced by a mechanical contact-breaker are based on the principle of monostable flip-flops, Schmidt's multivibrators or various resistance-capacitance networks.

However, none of these prior art devices is satisfactory since they all involve a time lag in the signal transmission. Moreover, as a rule, these known devices are connected directly between the contact breaker and the ignition system or device whereby the complete system would be detrimentally affected should a short-circuit occur in the known devices utilized.

It is the essential object of the present invention to avoid the above-mentioned inconveniences of the prior art devices by providing an electronic circuit for picking up and shaping the signal emitted by the breaker of a conventional or electronic ignition system which consists of an infrared optical coupler having its emitter connected to the terminal common to the breaker and the ignition coil of the ignition system via a signal calibration circuit and having the receiver of the infrared optical coupler being connected to the base of a transistor operating between the locked and saturated conditions wherein the output terminals of said transistor are connected to a stray-eliminating circuit.

According to a characteristic feature of the electronic circuit of the present invention, the emitter of the infrared optical coupler is connected to the junction point of the breaker, the ignition coil and the capacitor, which capacitor is normally utilized in ignition systems and which is connected in parallel to said breaker. Said infrared optical coupler is connected to said junction point via a pair of series-connected resistors and a rectifying diode and a calibration Zener diode connected in parallel.

According to a further feature characterizing this invention, the transistor provided at the output of the infrared optical coupler has its emitter grounded, its collector connected to the positive terminal of the ignition system battery wherein the transistor collector output is connected to the stray-eliminating circuit comprising a series-connected resistor and a parallel-connected Zener diode.

According to another feature of the present invention, the infrared optical coupler is of the $H_{15}B_2$ type manufactured by GENERAL ELECTRIC.

Other features and advantages of this invention will appear from the following description with reference to the accompanying drawing of which the single FIGURE is a wiring diagram of the electronic circuit constituting the subject-matter of this invention.

In the drawing, the conventional arrangement of the component elements of the ignition system of an internal combustion engine is shown with the contact breaker 1 connected in series with the primary winding 2 of the ignition coil between the ground and the positive terminal of the battery. A capacitor 3 is disposed in parallel to the breaker 1 according to the conventional method. An electroluminescent diode 10 emitting in the near infrared range has one end connected to the junction point 4 of breaker 1, the primary winding 2 and the capacitor 3 via a pair of series-connected resistors 5 and 6. Resistor 5 is adpted to limit the current flowing through the diodes 7 and 8, and resistor 6 sets the biasing current in the electroluminescent diode 10. A diode 7 disposed between the output of resistor 5 and the ground rectifies the signal from breaker 1 by removing the negative portion of the signal. A Zener diode 8 disposed between the input of resistor 6 and the ground is adapted to calibrate the signal at the permissible voltage through the electroluminescent diode 10 which has one of its terminals connected to resistor 6 and the other terminal grounded.

A phototransistor 20, constituting the receiver of the infrared optical coupler of which the emitter is the electroluminescent diode 10, has its emitter grounded and its collector connected to the positive terminal of the battery via a series-connected resistor 21 delivering a predetermined current output. The collector of phototransistor 20 is also connected to the base of a transistor 22 via a biasing resistor 23. The emitter to collector gap of transistor 22 is connected between the ground and the positive terminal of the battery, and the stage output is taken from the collector of transistor 22 by a conductor 26 which incoporates a resistor 24 in series. The stage output in combination with a Zener diode 25 connected between the ground and the end of said resistor 24 constitutes a stage for protecting the circuit from stray signals.

The signal from breaker 1, taken across the terminals thereof between the point 4 and the ground, is adapted to bias the electroluminescent diode 10 whereby the latter emits in the near infrared range in front of phototransistor 20 receiving this radiation.

The phototransistor 20 is locked when no signal is applied thereto, i.e., when the contacts of breaker 1 are closed. Phototransistor 20 is saturated when the contacts of breaker 1 are open. This saturation occurs with a current of 1.4 mA, for example, and in a negligible time lag of the order of 100 $\mu$s. Resistor 21 delivers a 1.2 mA output, whereby transistor 22 is saturated through the base resistor 23. The signal picked up from the collector of transistor 22 via resistor 28 is reduced to 5 Volts by resistor 24 and diode 25, thus eliminating possible strays which occur generally at a voltage level above 6 Volts.

The assembly comprising the electroluminescent diode 10 and phototransistor 20 is available in the trade in the form of an integrated unit such as the unit denoted $H_{15}B_2$ in the Catalogue of GENERAL ELECTRIC.

The advantages deriving from this circuit in comparison with all presently known circuits designed for picking up and shaping breaker signals from a conventional or electronic ignition system, may be described as follows:

1°—The output signal carried by conductor 26 is electrically insulated from the breaker signal thus avoiding any accidents such as the destruction of components due to overloads caused by breaking extra-current voltages which may be as high as several hundreds volts, 2°—the output signal carried by conductor 26 may be transmitted via a non-shielded wire because the output has a low-level voltage and low impedance (6 Volts, 100 ohms), thus preventing any interference by diaphony in data transmitted through the same cluster of conductors.

3°—The output signal carried by conductor 26 has a constant amplitude for a battery voltage in the range of 11 to 17 Volts and is directly compatible with DTL, TTL, RTL, MOS devices.

4°—The operation of the engine equipped with the ignition system incorporating the circuit of the present invention cannot be impaired by failure of the signal shaping circuit, e.g., a short circuit, as distinguished from hitherto known shaping circuits which, on the whole, are an integral part of the ignition circuit proper.

5°—The cost of the circuit according to this invention is low since it utilizes no capacitors; therefore, should mass production be contemplated, an integrated form may be utilized, and 6°—The absence of capacitors eliminates any possibility of aging and drift.

The quality of the signals collected on output conductor 26, as far as their shape is concerned, is such that these signals can be utilized directly in counting circuits and in all known logic circuits. The receiving portion of the infrared optical coupler consists of a DARLINGTON circuit within the $H_{15}B_2$ component in order to provide increased power.

Therefore the circuit according to this invention is capable of shaping ignition signals in such a manner as to synchronize the functions of an electronic computer. The circuit according to this invention utilizes an electronic element capable of electrically insulating the computer from the ignition circuit and, therefore, to reduce its sensitivity to strays from the ignition system.

What we claim is:

1. An electronic circuit for an ignition coil electrically connected to the positive terminal of the battery, a circuit breaker connected in series with the ignition coil and positive battery terminal, a capacitor connected in parallel with said circuit breaker, a series circuit including a first resistor connected in series with a parallel connected rectifying diode and calibrating first Zener diode, said series circuit connected in parallel with said capacitor, an optical coupler comprising a light emitting means for emitting light and a light receiving means for receiving the emitted light from the light emitting means, said light emitting means connected in series with a second resistor, said serially connected light emitting means and second resistor connected in parallel with said parallel connected rectifying diode and calibrating Zener diode combination, a transistor having a base, emitter, and a collector, said light receiving means connected to the base of said transistor, said transistor emitter connected to a ground, and said transistor collector connected to the positive terminal of the battery, and a third resistor connected in series with a second Zener diode, said serially connected third resistor and second Zener diode connected in parallel with the emitter and collector terminals of the transistor.

2. The circuit of claim 1, wherein said light emitting means comprises a light emitting diode, and said light receiving means comprising a phototransistor, said phototransistor including a phototransistor emitter connected to a ground, and a phototransistor collector connected to said transistor base.

3. The circuit of claim 2, wherein said phototransistor collector is further connected in series with a fourth resistor and the positive terminal of the battery.

* * * * *